US009243813B2

(12) United States Patent
Mantyla et al.

(10) Patent No.: US 9,243,813 B2
(45) Date of Patent: Jan. 26, 2016

(54) ROOF VENT

(75) Inventors: James Brian Mantyla, Barrie (CA); Timothy Duane Bach, Barrie (CA); Donna Maria Burtch, Stayner (CA); Kent Douglas Proctor, Barrie (CA)

(73) Assignee: Canplas Industries Ltd., Barrie, Ontario (CA)

( * ) Notice: Subject to any disclaimer, the term of this patent is extended or adjusted under 35 U.S.C. 154(b) by 1094 days.

(21) Appl. No.: 13/291,396

(22) Filed: Nov. 8, 2011

(65) Prior Publication Data

US 2013/0078903 A1 Mar. 28, 2013

(30) Foreign Application Priority Data

Sep. 22, 2011 (CA) ..... 2753482

(51) Int. Cl.

| | |
|---|---|
| ***F24F 13/20*** | (2006.01) |
| ***B60H 1/00*** | (2006.01) |
| ***B60S 1/54*** | (2006.01) |
| ***B60J 7/22*** | (2006.01) |
| ***E04H 12/00*** | (2006.01) |
| ***F24F 13/22*** | (2006.01) |
| ***F24F 7/02*** | (2006.01) |

(52) U.S. Cl.

CPC ..... *F24F 13/222* (2013.01); *F24F 7/02* (2013.01)

(58) Field of Classification Search

USPC ..... 454/367, 100, 127, 129, 136; 52/301, 52/199

IPC ..... F24F 13/222,7/02, 7/025, 7/082

See application file for complete search history.

(56) References Cited

U.S. PATENT DOCUMENTS

| | | | |
|---|---|---|---|
| 1,588,321 | A | 6/1926 | Lord |
| 1,794,673 | A | 3/1931 | Creager |
| 2,218,348 | A | 10/1940 | Boyer |
| 2,274,403 | A | 2/1942 | Filkins |
| 2,344,789 | A | 3/1944 | Schmerling |

(Continued)

FOREIGN PATENT DOCUMENTS

| | | | |
|---|---|---|---|
| CA | 467801 | A | 9/1950 |
| CA | 1280024 | | 2/1991 |
| CA | 2002710 | | 5/1991 |
| CA | 2120118 | A1 | 9/1995 |
| CA | 2129375 | A1 | 2/1996 |
| CA | 2267823 | A1 | 6/2000 |
| CA | 2405534 | A1 | 2/2001 |

(Continued)

OTHER PUBLICATIONS

G. Beall; "By Design: Polypropylene part design, Part 2—Living hinges", Published: Jul. 24, 2002, Plastics Today, 2 pages.

(Continued)

*Primary Examiner* — Steven B McAllister
*Assistant Examiner* — Helena Kosanovic
(74) *Attorney, Agent, or Firm* — Hoffmann & Baron, LLP

(57) ABSTRACT

A vent for a building has a cover attached to a base. The base has an aperture permitting gas to pass. A moisture directing means on an underside of the cover directs moisture move under the influence of gravity to fall outside of the aperture. The cover may include a slanted side wall portion, with the aperture positioned with its center displaced from the center of the cover toward the slanted side. The base may include a pair of moisture deflecting features along at least a portion of one of the nonslope sides to prevent moisture flowing along the base from within an area on the base covered by the cover to outside of the covered area at the nonslope sides. The base may also include a water deflecting ridge on its underside positioned between a downslope edge and the aperture to deflect water away.

2 Claims, 17 Drawing Sheets

(56) References Cited

U.S. PATENT DOCUMENTS

| | | | | |
|---|---|---|---|---|
| 2,692,548 | A | 10/1954 | Knorr | |
| 2,695,554 | A | 11/1954 | Jenson et al. | |
| 2,741,972 | A | 4/1956 | Pryne | |
| 2,763,196 | A | 9/1956 | Singleton | |
| 2,890,642 | A | 6/1959 | Fernsten et al. | |
| 2,909,113 | A | 10/1959 | Hatcher | |
| 2,923,225 | A | 2/1960 | Massey | |
| 3,075,450 | A | 1/1963 | Noll | |
| 3,082,677 | A | 3/1963 | Pease | |
| 3,093,059 | A | 6/1963 | Metz | |
| 3,094,915 | A | 6/1963 | Leigh | |
| 3,250,206 | A | 5/1966 | Strouth | |
| 3,267,833 | A | 8/1966 | Artis et al. | |
| 3,579,930 | A | 5/1971 | Murphy | |
| 3,645,850 | A | 2/1972 | Ichishima et al. | |
| 3,783,767 | A | 1/1974 | Stalker | |
| 3,886,852 | A | 6/1975 | Acosta | |
| 3,895,467 | A | 7/1975 | Clement | |
| 3,934,383 | A | 1/1976 | Perry et al. | |
| 4,144,802 | A | 3/1979 | Babin | |
| 4,151,789 | A | 5/1979 | Grobard | |
| 4,184,414 | A | 1/1980 | Jarnot | |
| 4,229,916 | A | 10/1980 | White | |
| 4,297,818 | A * | 11/1981 | Anderson | 52/199 |
| 4,432,273 | A | 2/1984 | Devitt | |
| 4,585,243 | A | 4/1986 | Lockwood et al. | |
| 4,593,504 | A | 6/1986 | Bonnici et al. | |
| 4,625,630 | A | 12/1986 | Carroll et al. | |
| 4,635,168 | A | 1/1987 | Crowley | |
| 4,730,552 | A | 3/1988 | Murray | |
| 4,759,270 | A | 7/1988 | Lindeen | |
| 4,817,506 | A | 4/1989 | Cashman | |
| 4,850,265 | A | 7/1989 | Raisanen | |
| D304,367 | S | 10/1989 | Saas | |
| 4,875,317 | A | 10/1989 | Logan et al. | |
| 4,899,505 | A | 2/1990 | Williamson et al. | |
| 4,903,445 | A | 2/1990 | Mankowski | |
| 4,924,761 | A | 5/1990 | MacLeod et al. | |
| 4,942,699 | A | 7/1990 | Spinelli | |
| 5,000,409 | A | 3/1991 | MacLeod et al. | |
| 5,036,636 | A | 8/1991 | Hasty | |
| 5,046,408 | A | 9/1991 | Eugenio | |
| 5,167,578 | A | 12/1992 | Legault | |
| 5,222,334 | A | 6/1993 | Hasty | |
| 5,304,095 | A | 4/1994 | Morris | |
| 5,344,363 | A | 9/1994 | Pollock | |
| 5,402,611 | A * | 4/1995 | Vagedes | 52/198 |
| 5,409,266 | A | 4/1995 | Baker | |
| 5,435,780 | A | 7/1995 | Ayles | |
| RE35,083 | E | 11/1995 | Roosevelt | |
| 5,498,204 | A | 3/1996 | Anderson et al. | |
| 5,528,872 | A | 6/1996 | Rotter | |
| 5,561,952 | A | 10/1996 | Damron | |
| D376,007 | S | 11/1996 | Thomas | |
| 5,588,267 | A | 12/1996 | Rodriguez et al. | |
| 5,591,080 | A | 1/1997 | Ward | |
| 5,655,964 | A | 8/1997 | Rheault et al. | |
| 5,662,522 | A | 9/1997 | Waltz | |
| 5,664,375 | A | 9/1997 | Ward | |
| 5,716,718 | A | 2/1998 | Lai | |
| 5,722,181 | A | 3/1998 | Meyer | |
| 5,749,780 | A | 5/1998 | Harder et al. | |
| 5,761,985 | A | 6/1998 | Stoll | |
| 5,772,502 | A | 6/1998 | Smith | |
| 5,775,032 | A | 7/1998 | Lacy | |
| 5,791,985 | A | 8/1998 | Schiedegger et al. | |
| 5,916,023 | A | 6/1999 | Meyer | |
| 5,960,595 | A | 10/1999 | McCorsley, III et al. | |
| 6,039,646 | A | 3/2000 | Sells | |
| 6,129,628 | A | 10/2000 | O'Hagin et al. | |
| 6,149,516 | A | 11/2000 | Mantyla | |
| 6,155,008 | A | 12/2000 | McKee | |
| 6,227,963 | B1 | 5/2001 | Headrick | |
| 6,233,887 | B1 | 5/2001 | Smith | |
| 6,260,315 | B1 | 7/2001 | Smith | |
| 6,267,668 | B1 | 7/2001 | Morris | |
| 6,277,024 | B1 | 8/2001 | Coulton | |
| 6,293,862 | B1 | 9/2001 | Jafine et al. | |
| 6,298,613 | B1 | 10/2001 | Coulton et al. | |
| 6,302,785 | B1 | 10/2001 | McKinney et al. | |
| 6,302,788 | B1 | 10/2001 | Gagnon | |
| 6,308,472 | B1 | 10/2001 | Coulton et al. | |
| 6,354,046 | B1 | 3/2002 | Swearingen | |
| 6,371,847 | B2 | 4/2002 | Headrick | |
| 6,383,072 | B2 | 5/2002 | Schiedegger et al. | |
| 6,389,755 | B1 | 5/2002 | Wenner | |
| 6,520,852 | B2 | 2/2003 | McKee et al. | |
| 6,565,431 | B1 | 5/2003 | Villela | |
| 6,599,184 | B2 | 7/2003 | Morris | |
| 6,612,924 | B1 | 9/2003 | Mantyla et al. | |
| 6,733,381 | B1 | 5/2004 | Ploeger | |
| 6,767,281 | B2 | 7/2004 | McKee | |
| 6,793,574 | B1 | 9/2004 | Robinson | |
| 6,932,690 | B2 | 8/2005 | Ramsay | |
| 6,981,916 | B2 | 1/2006 | Coulton | |
| 6,994,622 | B2 | 2/2006 | Koessler | |
| 6,997,800 | B1 | 2/2006 | Kohler | |
| 7,024,828 | B2 | 4/2006 | Headrick | |
| 7,024,829 | B2 | 4/2006 | Sharp et al. | |
| 7,066,371 | B2 | 6/2006 | Villela et al. | |
| 7,182,688 | B2 | 2/2007 | Coulton | |
| 7,219,473 | B2 | 5/2007 | Mantyla et al. | |
| 7,232,370 | B1 | 6/2007 | Newell | |
| D556,314 | S | 11/2007 | Daniels, II et al. | |
| 7,384,331 | B2 | 6/2008 | Coulton | |
| 7,774,999 | B2 | 8/2010 | McKee | |
| 7,780,510 | B2 | 8/2010 | Polston | |
| 8,033,900 | B2 | 10/2011 | Vanden Bosch et al. | |
| 8,069,621 | B2 | 12/2011 | Mantyla et al. | |
| 8,205,401 | B2 | 6/2012 | Ward | |
| 2003/0054754 | A1* | 3/2003 | McKee | 454/367 |
| 2003/0153262 | A1 | 8/2003 | Mantyla et al. | |
| 2004/0235411 | A1 | 11/2004 | Jones et al. | |
| 2006/0230694 | A1 | 10/2006 | Skov et al. | |
| 2007/0010190 | A1 | 1/2007 | Butler | |
| 2007/0049190 | A1 | 3/2007 | Singh | |
| 2007/0141975 | A1 | 6/2007 | Polston | |
| 2007/0173191 | A1 | 7/2007 | Daniels, II et al. | |
| 2008/0096480 | A1 | 4/2008 | Parry | |
| 2008/0182507 | A1 | 7/2008 | Morris et al. | |
| 2008/0287055 | A1 | 11/2008 | Exposito | |
| 2009/0049769 | A1 | 2/2009 | Kaseda | |
| 2009/0053990 | A1 | 2/2009 | McKee | |
| 2010/0064602 | A1 | 3/2010 | Moore | |
| 2010/0144266 | A1 | 6/2010 | Lowe et al. | |
| 2010/0227540 | A1 | 9/2010 | Smith | |
| 2010/0257798 | A1* | 10/2010 | Ward | 52/301 |
| 2010/0311319 | A1 | 12/2010 | McKee et al. | |
| 2011/0294412 | A1* | 12/2011 | Vagedes | 454/242 |
| 2013/0078903 | A1 | 3/2013 | Mantyla et al. | |
| 2013/0344796 | A1 | 12/2013 | Rossetta | |
| 2014/0106661 | A1 | 4/2014 | Baldwin et al. | |
| 2014/0342658 | A1 | 11/2014 | Parkinson et al. | |

FOREIGN PATENT DOCUMENTS

| | | | |
|---|---|---|---|
| CA | 2300803 | A1 | 8/2001 |
| CA | 2327795 | A1 | 3/2002 |
| CA | 2326371 | A1 | 5/2002 |
| CA | 2511742 | A1 | 1/2007 |
| CA | 2536023 | A1 | 8/2007 |
| CA | 2597366 | A1 | 2/2009 |
| CA | 2696466 | A1 | 9/2010 |
| GB | 2423814 | A * | 9/2006 |

OTHER PUBLICATIONS

Polypropylene—The Definitive Users Guide and Data Book—para 2-4-5; pp. 18-19.

* cited by examiner

ROOF VENT

CROSS-REFERENCE TO RELATED APPLICATIONS

This application claims priority benefit under 35 U.S.C. §119 of Canadian Patent Application No. 2,753,482, filed 22 Sep. 2011 in the name of Canplas Industries. Ltd., assignee of the present application, and naming as inventors the present inventive entity. The complete disclosure of this priority application is hereby incorporated herein in its entirely by this reference, for all purposes.

FIELD OF THE INVENTION

This invention relates generally to the field of venting devices, and in particular to passive venting devices.

BACKGROUND OF THE INVENTION

Virtually all buildings and structural enclosures where human activity takes place require venting. The type of venting device employed to provide the required venting will depend on the kind of enclosure to be vented and the use to which the vented space is put. For example, bathrooms containing showers typically have active vents with fans to vent moist air and steam from the enclosed bathroom to the outdoors. Kitchens, particularly in restaurants and hotels, similarly have powered vents for removing cooking byproducts such as smoke and steam to the outdoors.

Other types of enclosures, such as attics, do not require active venting. However, such enclosures do typically require a passive venting device to allow for air flow from the enclosure to the outdoors. Such venting is required, for example, to prevent a buildup of moisture in the enclosure. Rather than forcing air out of the enclosure, passive venting devices typically include a vent structure in the form of upstanding walls defining an aperture to allow airflow between the interior of the enclosure and the exterior of the building or structure. Passive venting devices can also include a screen to block animals, insects and other unwanted objects from entering the enclosure through the opening.

Passive venting devices are well-known and have been extensively used in the past. Notably, many jurisdictions have building codes that require passive venting devices for venting attic spaces. House attics and other similar enclosures are sometimes vented simply by one or more passive venting devices on the roof. The passive venting devices are each positioned above a ventilation passage or opening in the roof which permits air to flow from the building enclosure to the outside, and vice versa.

However, in addition to permitting air to flow from the building enclosure to the outside though the roof opening, prior art roof vents also tend to allow moisture to enter the building enclosure from the outside, which can cause damage to the building or structure and fosters growth of mold and mildew which can lead to health problems for occupants.

U.S. Pat. No. 6,767,281 to McKee discloses one prior art passive venting device that attempts to prevent precipitation from entering the building enclosure from the outside. The McKee venting device, which is a common passive venting device used to vent building enclosures, comprises a base member, including an attachment portion and a vent structure for permitting gas and vapour to pass through the device, a cover member mounted to the base member so as to permit the flow of gas and vapour to the outside, and a precipitation baffle which is sized, shaped and positioned to interfere with the entry of precipitation to the outside. The device also has a ventilation pathway spaced from the roof so as to permit thick shakes or tiles to be installed right up to the device without interfering with ventilation.

While the McKee venting device, and others like it are formed with a base having an aperture and a cover, and are generally effective at preventing moisture from entering the enclosure therethrough, there is room for improvement.

For example, during periods of heavy rain, the falling rain will hit the roof with sufficient force to bounce under the covers of prior art venting devices, and through their apertures into the enclosures they are venting. Heavy precipitation can also result in a flow of water along the slope of a roof which splashes and sprays when it encounters a prior art roof vent. The splash and spray from the flow of water against the prior art roof vent can also work its way under its cover and through its aperture into the enclosure. A steeply sloped roof can make this situation worse since water will naturally flow down a steeply sloped roof at a greater velocity as compared to a roof having a moderate slope or no slope at all. In addition to heavy precipitation, snow and ice melting on a roof may also lead to a flow of water along the slope of the roof.

U.S. Pat. No. 6,520,852, also to McKee, discloses another passive vent for venting a building enclosure which attempts to prevent splashing and spraying caused by the flow of water down a sloped roof with an upstanding portion having a peak on one side which helps to deflect the water flow around the venting device. However, providing a peak on the upstanding portion of the passive vent, or other irregular shapes, creates the potential for other problems, such as for example, overcutting shingles to match the outline of the roof vent, creating holes for water to gain pathways into the shingles to the roof surface underneath, and into the roof opening bypassing the roof vent altogether.

Providing passive vent devices with other irregular shapes, for example to accommodate attachment parts, especially parts positioned along sides of the venting device, also makes it difficult or inconvenient to install shingles right up against the vent structure. This results in a space between the contours of the vent structure of the vent device and the shingles, permitting water to work its way under the shingles from the side, which is yet another way in which moisture can enter a building enclosure, essentially bypassing the roof vent.

Another attempt for dealing with heavy water flows on sloped roofs is disclosed in U.S. Pat. No. 3,093,059 to Metz. Metz discloses a roof ventilator with removable hood wherein the hood presents an apron section which slopes downwardly and rearwardly and terminates in a rearwardly directed tongue lying parallel with and in touching contact with a base plate. In heavy rain, the sloped apron of the hood will allow the flow of water to run over the top of the hood covering a collar which is in communication with the ventilation opening in the roof. However, since the collar is positioned forwardly of the sloped apron section, moisture is still liable to work its way through the collar and into the ventilation opening of the Metz roof ventilator.

Yet another attempt at reducing water entry into passive venting devices is shown in U.S. Pat. Application No. 2007/0049190 filed by Singh. Singh discloses a protective barrier adapted to fit over a conventional roof vent, particularly an off-ridge roof vent, which provides for ventilation and also restricts the passthrough of wind driven rainwater. The off-ridge roof vent comprises a top having an inflection, a front lip, two openings covered by screen mesh, and an interior entrance into an attic space. The off-ridge roof vent, which lacks a separate base portion for attachment to the roof, is positioned over the interior entrance into an attic space between the upslope side and the inflection. However, the lack of a separate base makes attaching and sealing the off-ridge roof vent to the roof more difficult.

Other prior art patents of general interest in the field of passive venting devices include U.S. Pat. No. 3,094,915 to Leigh, U.S. Pat. No. 3,579,930 to Murphy, U.S. Pat. No. 3,895,467 to Clement, U.S. Pat. No. 4,184,414 to Jarnot, U.S. Pat. No. 4,297,818 to Anderson, U.S. Pat. No. 4,759,270 to Linden, U.S. Pat. No. 4,899,505 to Williamson, U.S. Pat. No. 5,664,375 to Ward, U.S. Pat. No. 6,293,862 to Jafine, U.S. Pat. No. 6,612,924 to Mantyla, U.S. Pat. No. 6,520,852 to McKee, U.S. Pat. No. 6,733,381 to Ploeger, U.S. Pat. No. D304,367 to Saas, U.S. Pat. No. D376,007 to Thomas, and U.S. Pat. No. D556,314 to Daniels.

Another way in which moisture can enter a building enclosure through prior art passive roof venting devices is through condensation that accumulates inside the venting device, typically under the cover, as a result of a temperature difference between the venting device and the air flowing therethrough. The condensed moisture often collects on the underside surface of the cover of the prior art roof vents and drips down through the opening into the building enclosure.

While attempts have been made by others at directing water about the exterior of venting devices and other devices, none have dealt with the problem of how to prevent moisture condensing on an interior of a passive venting device and dripping into the enclosure.

SUMMARY OF THE INVENTION

In view of the foregoing, there is a continuing need for improvements in passive roof vent designs. What is desired is a passive roof vent which is inexpensive to manufacture and install, and which overcomes at least some of the problems associated with prior art.

The present invention is directed to a passive roof vent with improvements to help prevent moisture entering from outside of the roof vent to inside of the enclosure, for example moisture condensing on an underside of the cover of a roof vent and dripping into the attic below.

One embodiment of the present invention has a cover attached to a base, which has an attachment element and an aperture. The attachment element permits the roof vent to be attached to a roof with the aperture in the base positioned over an opening in the roof to permit gases to pass therethrough. The cover is attached to the base and covers the aperture. Preferably the cover includes one or more ribs attached to its underside surface. The one or more ribs are preferably sized and shaped to direct and guide moisture therealong to fall onto the base rather than into the roof opening through the aperture. Preferably the cover also includes a slanted side wall portion extending from a top wall to the base, and the aperture is positioned on the base away from the center of the cover, so that the center of the aperture is displaced from the center of the cover toward the slanted side wall portion. Preferably, the base also includes a pair of moisture deflecting features that are positioned on the base adjacent to the sides of the cover when attached to the base. Each moisture deflecting feature extends along at least a portion of one of the sides of the cover to prevent moisture from flowing, under the influence of gravity, along the base from within an area on the base which is covered by the cover to outside of the covered area.

Therefore, according to one aspect of the invention, there is provided a vent for venting a building enclosure, the vent comprising:

a base comprising an attachment element for attaching said base to said building enclosure and an aperture to permit gas to pass in to and out of said building enclosure through said base;

a cover for covering said aperture;

at least one attachment structure configured to attach said cover to said base; and a moisture directing means associated with an underside surface of said cover, said moisture directing means being sized and shaped to direct and guide moisture therealong;

wherein when said vent is installed on said building enclosure, moisture adhered to said underside surface of said cover moves, under the influence of gravity, to said moisture directing means and said moisture directing means directs said moisture therealong to fall onto said base outside of said aperture.

According to another aspect of the invention, there is provided a vent for venting a building enclosure, the vent comprising:

a base comprising an attachment element for attaching said base to said building enclosure and an aperture to permit gas to pass in to and out of said building enclosure through said base;

a cover attached to said base for covering said aperture, said cover having a top wall and a side wall, said side wall including a slanted side wall portion, the top wall and the slanted side wall portion being angled relative to one another, said slanted side wall portion extending from said top wall to said base; and at least one attachment structure attaching said cover to said base;

wherein said aperture is positioned on said base such that the center of the aperture is displaced from the center of the cover toward said slanted side wall portion.

According to yet another aspect of the invention there is provided a vent for venting a sloped building enclosure, the vent having an upslope side, a downslope side, and a pair of nonslope sides, the vent comprising:

a base comprising an attachment element for attaching said base to said building enclosure and an aperture to permit gas to pass in to and out of said building enclosure through said base;

a cover attached to said base for covering said aperture, said cover having a top wall and a side wall defining a covered area on said base, said side walls including a pair of side walls extending to said base on said nonslope sides of said vent;

a pair of moisture deflecting features, each said moisture deflecting feature being positioned on said base along at least a portion of one of said pair of nonslope sides of said vent; and at least one attachment structure attaching said cover to said base.

wherein said moisture deflecting features prevent moisture flowing under the influence of gravity along said base from within said covered area to outside of said covered area at said nonslope sides.

According to yet another aspect of the invention there is provided a vent for venting a sloped building enclosure, the vent comprising:

a base comprising an attachment element for attaching said base to said building enclosure and an aperture to permit gas to pass in to and out of said building enclosure through said base, said base having an underside surface, and a downslope side;

a cover for covering said aperture;

at least one attachment structure configured to attach said cover to said base; and a water deflector ridge disposed on said underside surface of said base, said water deflector ridge being positioned between an edge of said downslope side and said aperture;

said water deflector ridge being adapted to deflect water forced under said base up the slope of said building enclosure, in directions along the slope of the building enclosure but away from said aperture, when said vent is installed on said building enclosure.

BRIEF DESCRIPTION OF THE DRAWINGS

Reference will now be made, by way of example only, to drawings of the invention, which illustrate the preferred embodiment of the invention, and in which.

DETAILED DESCRIPTION OF THE PREFERRED EMBODIMENTS

The present invention is described in more detail with reference to exemplary embodiments thereof as shown in the appended drawings. While the present invention is described below including preferred embodiments, it should be understood that the present invention is not limited thereto. Those of ordinary skill in the art having access to the teachings herein will recognize additional implementations, modifications, and embodiments which are within the scope of the present invention as disclosed and claimed herein. In the figures, like elements are given like reference numbers. For the purposes of clarity, not every component is labelled in every figure, nor is every component of each embodiment of the invention shown where illustration is not necessary to allow those of ordinary skill in the art to understand the invention.

Figure 1:
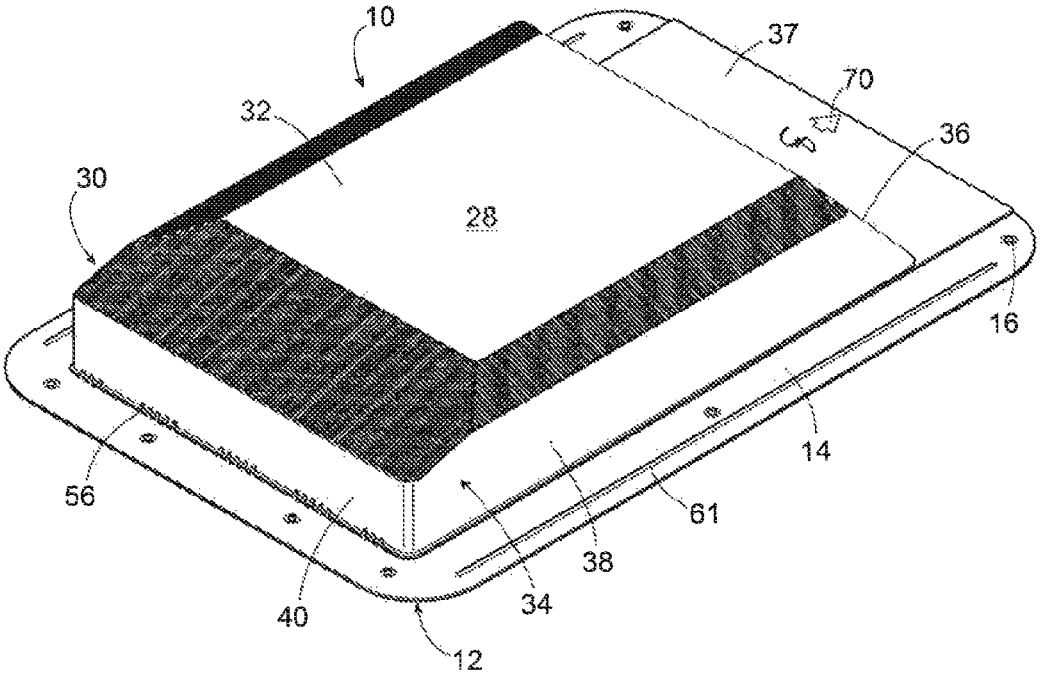
FIG. 1 is a perspective view of a roof vent according to an embodiment of the present invention.
Figure 2:
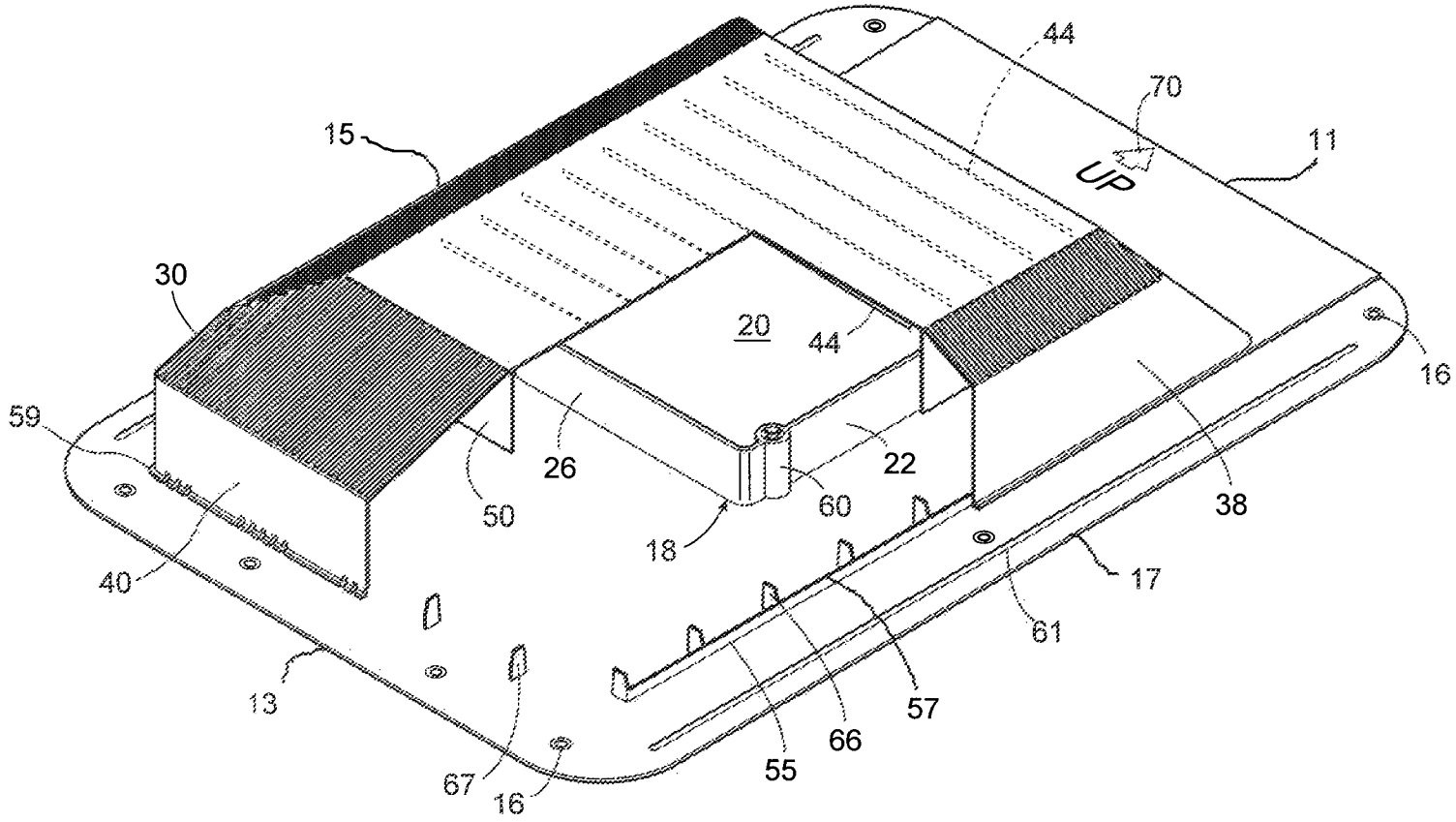
FIG. 2 is a perspective view of the roof vent of FIG. 1 with a section of the cover cut away to show the interior, and features on the underside of the cover shown with dashed lines.

FIGS. 1 and 2 show a vent 10 according to an embodiment of the present invention, for venting gases and vapours from an enclosure to the outside while at the same time preventing moisture, insects, and animals from entering the enclosure through the vent. The vent shown is a roof vent 10 for attachment to a sloped roof, and has an upslope side 11 for facing up the slope of the sloped building enclosure, a downslope side 13 opposite the upslope side 11 for facing down the slope of the sloped building enclosure, and a pair of opposed sides 15, 17 extending from the upslope side to the downslope side.

Preferably, the vent 10 will be manufactured from molded plastic. Moldable plastics are available which provide adequate performance in the range of weather conditions that a typical passive venting device must endure. Furthermore, the use of a plastic molding process allows a high volume of devices to be manufactured at a low per-unit cost. Thus the preferred plastics are those which can be made to conform to the shape of a suitable mold. Preferred plastics include PP and PE. Preferred molding techniques include injection molding, thermoforming, reaction injection molding, compression molding, and the like. Nevertheless, it will be appreciated that the vent 10 need not be composed of molded plastic, but may be composed of any material which allows the vent 10 to adequately perform its necessary functions. Thus, for example, the vent 10 could be composed of metal.

As shown in FIG. 1, the vent 10 has a base 12 and a cover 28. The base 12 has an aperture 20 and an attachment element extending outwardly from said aperture 20. The attachment element is preferably a flat outer flange 14 adapted to secure the base 12 to a building enclosure, such as for example a roof, with the aperture 20 positioned over a ventilation opening in the roof. Accordingly, the vent 10 is adapted for attachment to the roof with the aperture 20 in fluid communication with the ventilation opening in the roof to establish a ventilation passage for gases and vapours to pass in to and out from the building. The outer flange 14 preferably includes nailing holes 16 to allow nails to be driven therethrough and into the roof to secure the base 12 to the roof. The outer flange 14 permits shingles to be lapped thereover, so the vent 10 is readily integrated into a shingled roof in a waterproof manner.

It will be appreciated that the present invention comprehends various forms of attachment elements other than the outer flange 14 shown for the preferred embodiment. What is important is that the vent 10 has an attachment element which allows the base 12 to be secured appropriately in fluid communication with the aperture 20 in order to allow venting to take place. Thus, for example, the attachment element may be a different shape than the outer flange 14 of the preferred embodiment. Also, the nailing holes 16 may be omitted from the attachment element. The attachment element may instead be attached to the roof by other suitable means, such as screws, glue or any other means that results in the base 12 being appropriately secured in fluid communication with an aperture 20 in the roof of the building enclosure.

Figure 6:
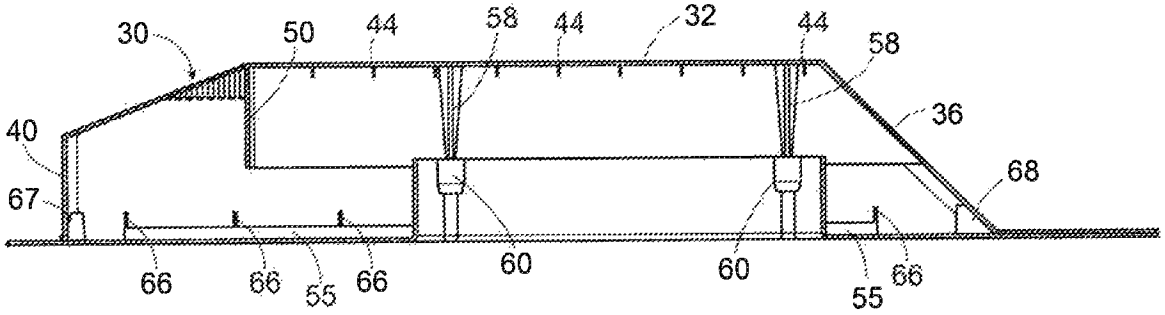
FIG. 6 is a cross-sectional view of the roof vent of FIG. 4 taken along line 6-6.

The base 12 further includes an aperture surrounding wall 18, as seen in FIG. 2. The aperture wall 18 is comprised of two lateral wall sections 22, an upward wall section 24 and a downward wall section 26 (best seen in FIG. 6). The upward wall section 24 is intended to be oriented to face up the slope of the roof when the vent 10 is installed on a sloped roof, while the downward wall section 26 will face down the slope of the roof. The lateral wall sections 22 are preferably oriented sideways when the device is installed on a sloped roof.

The aperture 20 is thus, in the preferred embodiment, formed by the upper edges of the wall sections 22, 24 and 26 of the aperture surrounding wall 18. The aperture 20 is preferably generally rectangular in shape in plan view. However, it will be appreciated that this particular preferred structure is not necessary for the invention. What is important is that the vent structure includes an aperture 20 through which air can flow from inside the building enclosure to the outside.

It will be appreciated that the aperture 20 is spaced upward from the outer flange 14, as it is defined by the aperture wall 18. On a sloped roof, during periods of rain or when snow is melting, water will flow down the roof and onto the outer flange 14. Because the aperture 20 is spaced apart from the outer flange 14, this water does not flow into the building enclosure through the aperture 20. Rather, the water will typically strike the upward wall section 24, flow around the aperture surrounding wall 18, and then continue down the sloped roof.

The vent 10 further comprises a cover 28 mounted to the base 12. The purpose of the cover 28 is to cover the aperture 20, thus preventing precipitation from falling directly through the aperture 20 and into the building enclosure. The cover 28 is, in a preferred embodiment, generally rectangular in plan view, and has a generally flat and solid top wall 32, and a side wall 34 that extends around the top wall. The side wall 34 is comprised of a slanted wall portion 36, lateral wall portions 38 and a bottom wall portion 40. The slanted wall portion 36 is located on the upper side of the cover 28, which is the side that faces upward when the vent 10 is installed on a sloped roof. The slanted wall portion 36 is connected to top wall 32 at an angle relative to the plane of top wall 32, and includes a flange portion 37 which is angled relative to the bottom edge of slanted wall portion 36. The flange portion 37 of slanted wall portion 36 completely overlaps the top portion of the outer flange 14 of base 12, in order to provide a seal when the vent 10 is nailed to the roof by an installer.

Figure 3:
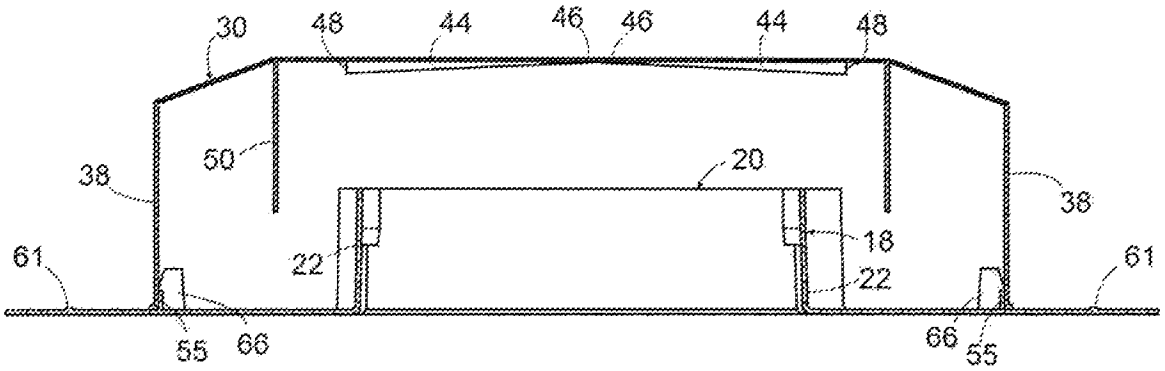
FIG. 3 is an elevation cross-sectional view of the roof vent of FIG. 2.
Figure 4:
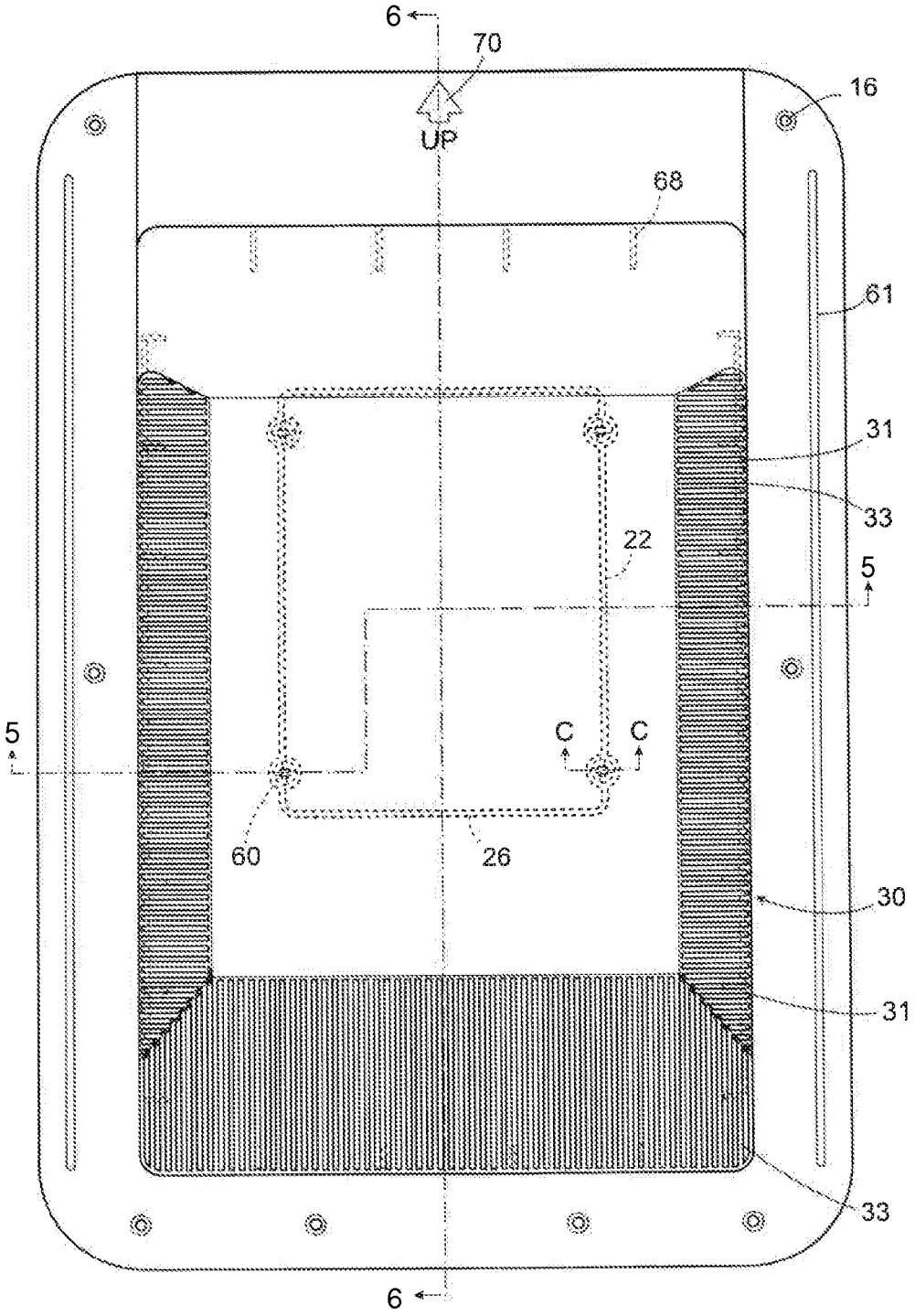
FIG. 4 is a top view of the roof vent of FIG. 1, with features on the base shown with dashed lines.
Figure 5:
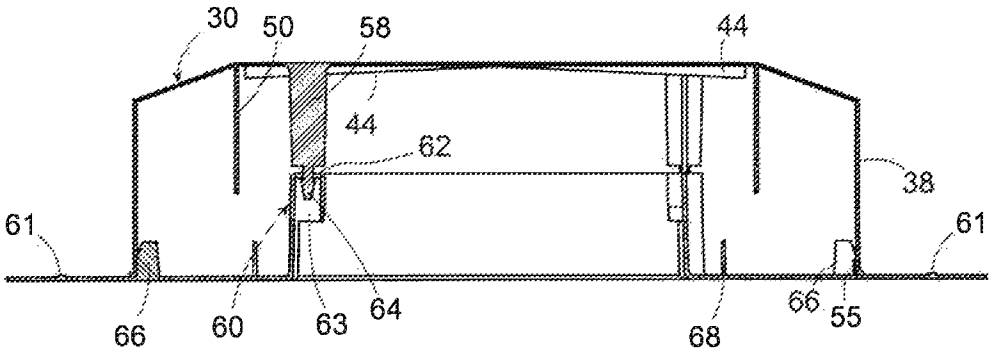
FIG. 5 is a cross-sectional view of the roof vent of FIG. 4 taken along line 5-5.

The cover 28 also includes one or more moisture directing means, preferably in the form of moisture directing ribs 44. This feature is best illustrated in FIG. 3. The ribs 44 are preferably located on the underside surface of the cover 28, and most preferably above the aperture 20 when the vent 10 is mounted onto a roof. In a preferred embodiment, the moisture directing ribs 44 will be molded onto the inner surface of the cover 28. However, other means of attachment to the cover 28 are also comprehended by the invention. What is important is that the moisture directing ribs 44 be secured to the underside of the cover 28.

In the preferred embodiment, each moisture directing rib 44 will taper outwardly from a first end 46 and terminate in a second end 48. The first end 46 can originate from any point within the region of the underside of cover 28 that is located over the aperture 20, most preferably a point that is centered over the aperture 20, and the second end 48 will be positioned at a point that is beyond the sides of the aperture 20. The second end 48 will be thicker than the first end 46, and in a preferred embodiment reaches a height of about ⅛ of an inch. As will be understood by those skilled in the art, moisture will adhere to the underside of cover 28 by means of surface tension. However, if the condensation droplets get too large, surface tension is overwhelmed and water drips off the cover. According to the present invention, moisture accumulating on the underside of the cover 28 and over the aperture 20 will adhere to the moisture directing ribs 44 through surface tension at the first end 46, then move, under the influence of gravity, along the moisture directing rib 44 to the second end 48 located away from the aperture 20. From the second end 48, the moisture will then fall onto the base 12 outside of the aperture surrounding wall 18 rather than through the aperture 20 and into the enclosure. The moisture directing ribs 44 can follow a straight line from the first end 46 to the second end 48, although they do not need to do so. For example, each moisture directing rib 44 could form a chevron pattern instead of a straight line.

It can now be understood that the present invention requires that the ribs 44 define a sloped path, when the vent 10 is installed on a roof, from above the aperture 20 to the outside of the aperture 20. The slope is directed downwardly from above the aperture 20 to outside of the aperture 20, in order to permit the water drops to run along the rib 44 before becoming large enough to drip off of the underside of the cover 28. The change in thickness of the rib 44 described above is to define a droplet path that slopes downwardly away from above the center of the aperture 20, regardless of the slope of the roof, provided that the vent is installed in the appropriate orientation. Although ribs 44 extending to the sides are preferred, the present invention also comprehends ribs extending downwardly relative to the roof slope.

It will be appreciated that the cover 28 may be mounted to the base 12 in any secure fashion. Conventional stake mounting has been found to be adequate. Thus, in the preferred embodiment, the cover 28 and base 12 are attached to each other by means of an attachment structure that includes attachment members 58 and attachment receptacles 60, the features of which are best seen in FIGS. 5, 6, 10, and 16. In the preferred embodiment, the attachment structure is comprised of four attachment members 58 and four corresponding attachment receptacles 60. The attachment members 58 can be located on the cover 28 and the attachment receptacles 60 located on the base 12, or vice versa. What is important is that the attachment members 58 and attachment receptacles 60 be sized and shaped to line up with each other, such that when an attachment member 58 is inserted into an attachment receptacle 60, the attachment member 58 is gripped within the attachment receptacle 60.

To achieve a firm grip when attachment members 58 are inserted into attachment receptacles 60, each attachment receptacle 60 has lips 62 at its opening and a locking slot 63. The lips 62 are compressible inwardly (i.e. into the locking slots 63), but not outwardly, and are biased to return to a closed position when not compressed. Each attachment member 58 has a head 64 at its tip, the head 64 being wider than the attachment member 58 at the point of attachment between the head 64 and the attachment member 58. To mount the cover 28 on the base 12, the attachment members 58 are lined up with the attachment receptacles 60. The attachment members 58 are then inserted into the locking slots 63 of attachment receptacles 60. The lips 62 compress inward as the attachment members 58 are inserted. Once the heads 64 move past the lips 62 and into the locking slot 63, the lips 62 move back to the closed position. As the lips 62 are not movable outward, the lips 62 hold the heads 64 in the locking slots 63 of attachment members 60, thus securely mounting the cover 28 onto the base 12.

Figure 7:
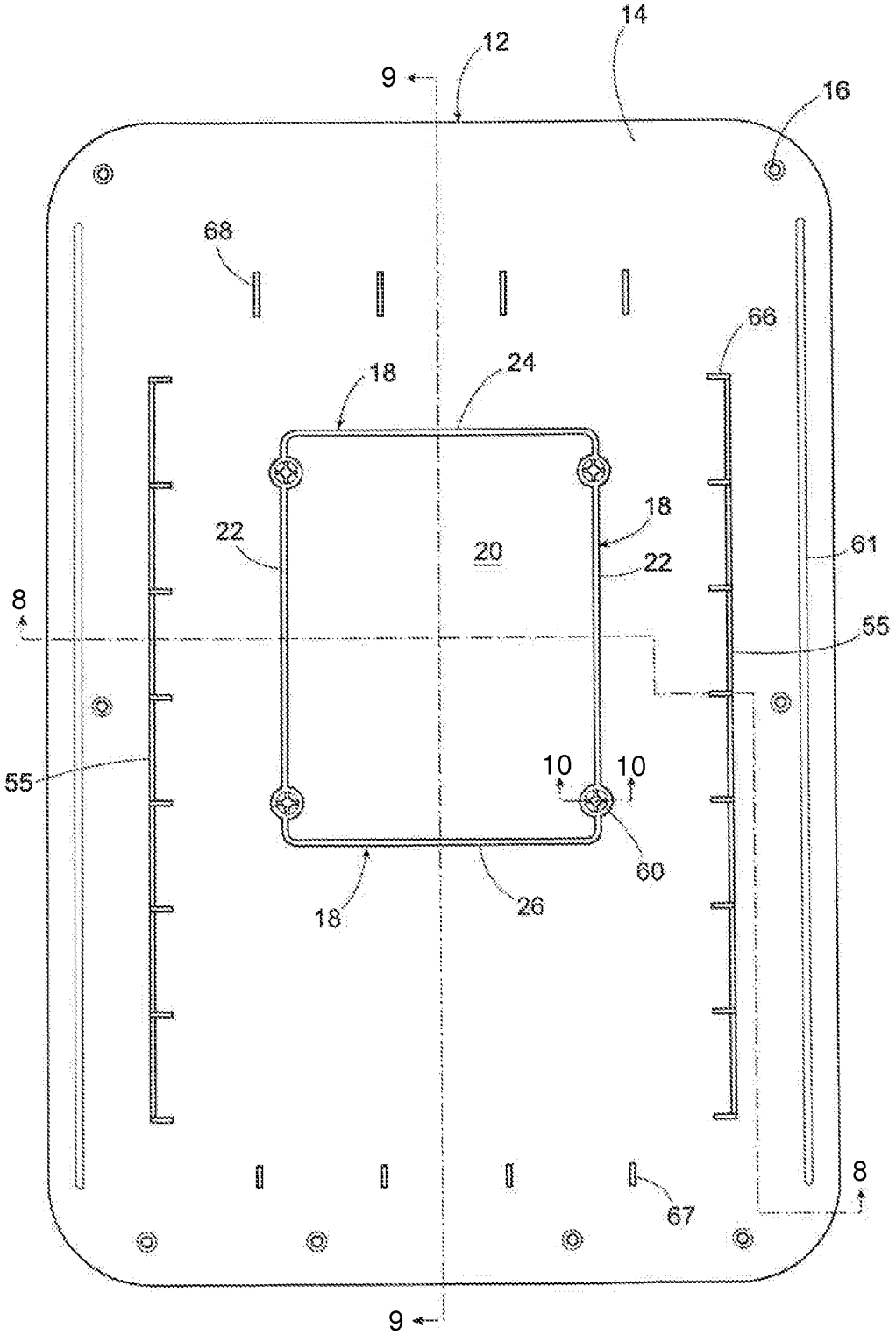
FIG. 7 is a top view of the roof vent of FIG. 1 showing only the base of the roof vent.
Figure 8:
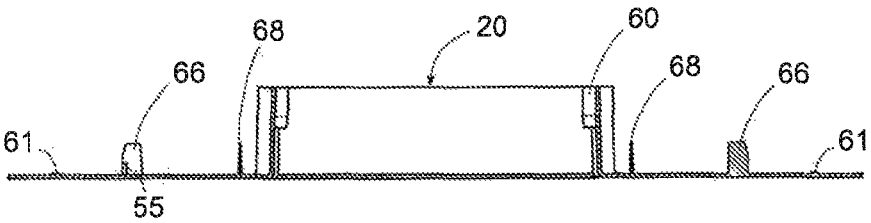
FIG. 8 is a cross-sectional view of the base of FIG. 7 taken along line 8-8.
Figure 9:
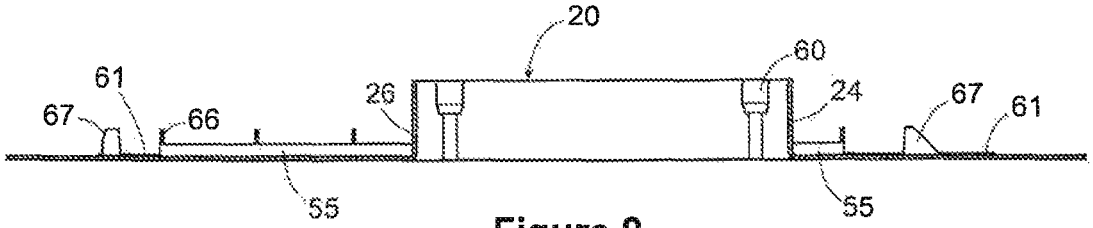
FIG. 9 is a cross-sectional view of the base of FIG. 7 taken along line 9-9.
Figure 10:
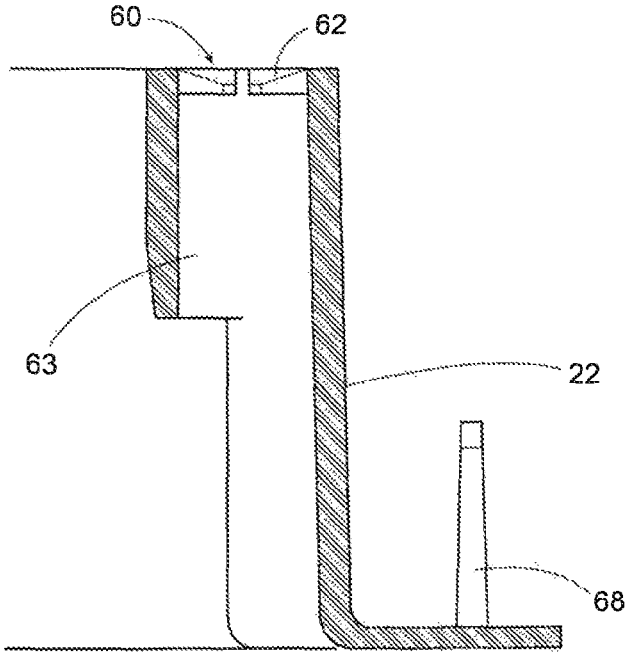
FIG. 10 is a cross-sectional view of the base of FIG. 7 taken along line 10-10.

FIG. 7 illustrates an embodiment of the base 12, in which the attachment receptacles 60 can be seen to be formed integrally within the lateral wall sections 22, adjacent to the corners of the aperture surrounding wall 18. However, it will be appreciated by those skilled in the art that this particular positioning on the aperture wall 18 is not required. For example, the attachment receptacles 60 could instead be located on the upper wall section 24 and downward wall section 26. As previously mentioned, attachment members 58 could instead be placed within the aperture wall 18, and the corresponding attachment receptacles 60 located on the cover 28.

The cover 28 and base 12 are sized, shaped and positioned so as to permit the flow of gas and vapour from inside the building enclosure, through the aperture 20 and to the outside. Thus, preferably, the cover 28 will have a ventilation pathway extending therethrough, in the form of a gas-permeable screen 30. The screen 30 connects lateral wall portions 38 and bottom wall portion 40 of side wall 34 to the top wall 32. In a preferred embodiment, the screen 30 will extend diagonally between top wall 32 and lateral wall portions 38 and bottom wall portion 40 of side wall 34.

Figure 11:
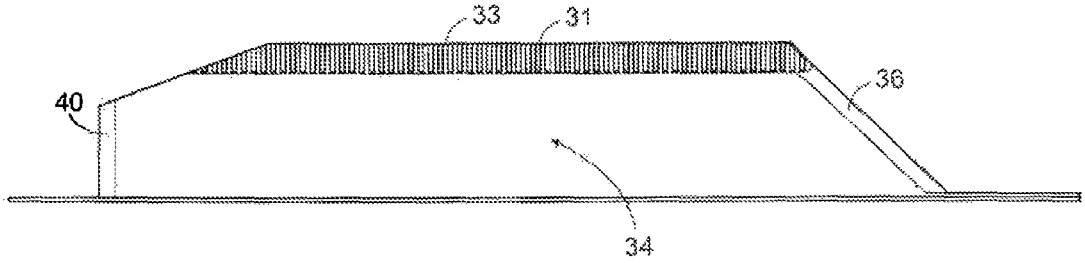
FIG. 11 is a side view of the roof vent of FIG. 1.
Figure 12:
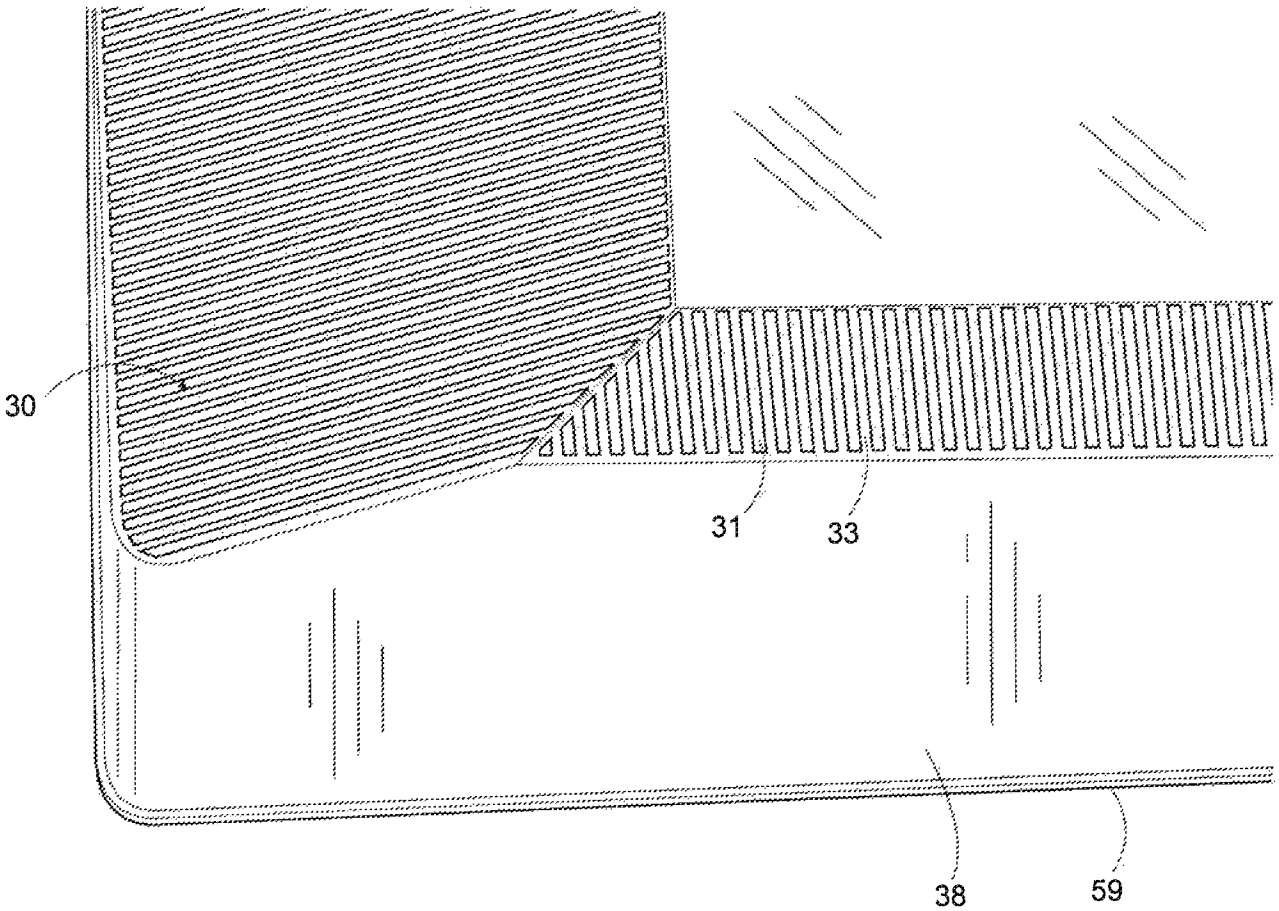
FIG. 12 is a perspective view of a detail of a cover of the roof vent of FIG. 1.
Figure 13:
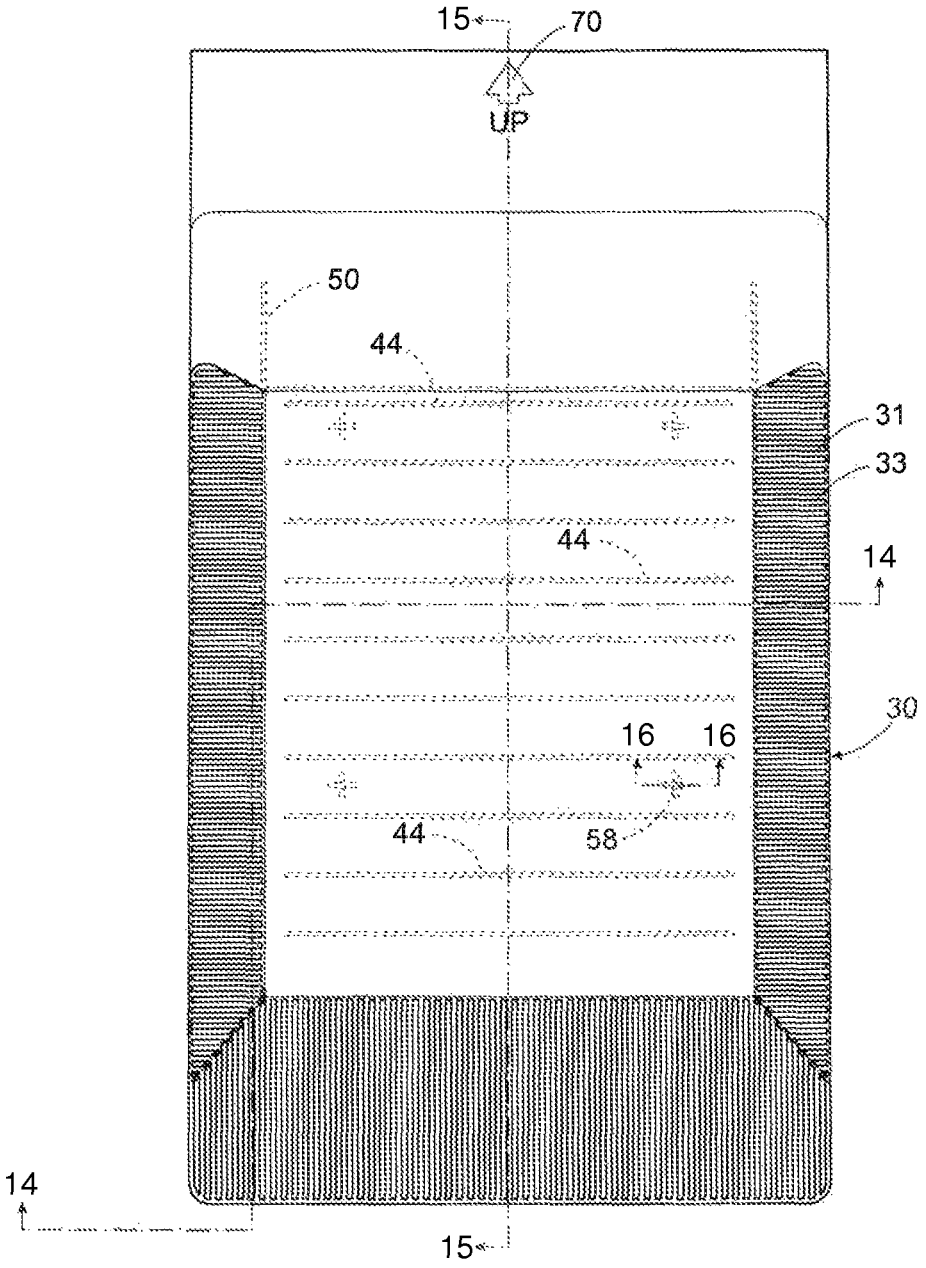
FIG. 13 is a top view of the roof vent of FIG. 1 showing only the cover, with features on the underside of the cover shown with dashed lines.
Figure 14:
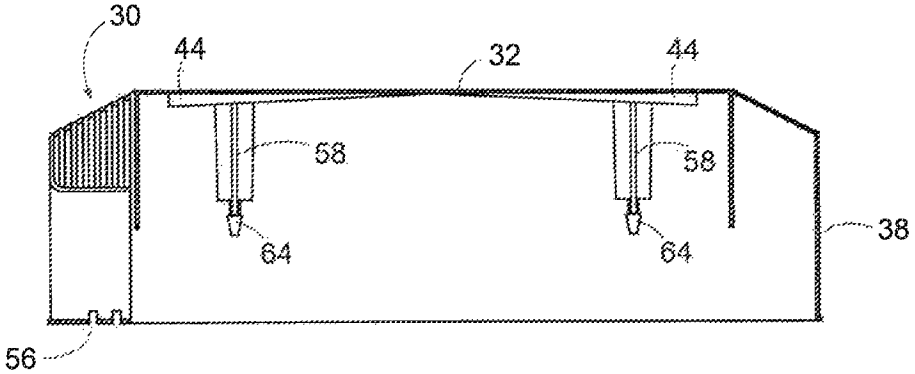
FIG. 14 is a cross sectional view of the cover of FIG. 13 taken along line 14-14.
Figure 15:
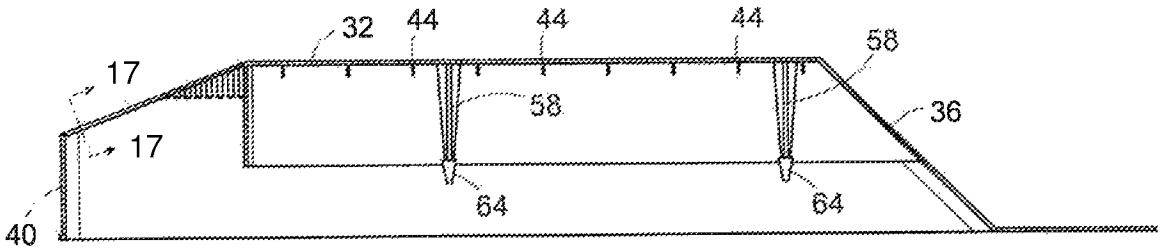
FIG. 15 is a cross sectional view of the cover of FIG. 13 taken along line 15-15.
Figure 16:
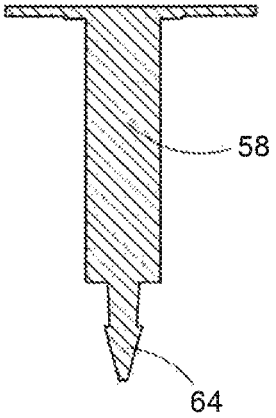
FIG. 16 is a cross sectional view of the cover of FIG. 13 taken along line 16-16.
Figure 17:
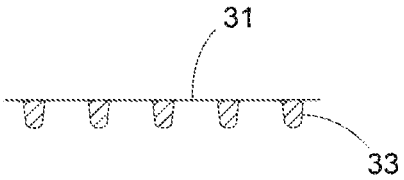
FIG. 17 is a cross sectional view of the cover of FIG. 15 taken along line 17-17.

The screen 30 should be sized, shaped and positioned to prevent objects from passing through the cover 28 and into the aperture 20, while at the same time allowing gas to flow out of the vent 10 to the outside. This can be accomplished by using a screen 30 that includes a plurality of air ventilation openings 31. As best seen in FIGS. 11 to 13 and particularly FIG. 17, the plurality of air ventilation openings 31 can be defined by a corresponding plurality of spaced apart slats 33. The slats 33 will preferably be spaced closely enough together to prevent objects from passing through the cover 28, while still allowing adequate air flow through the screen 30.

The vent 10 may further include a precipitation baffle 50 attached to top wall 32 of the cover 28. The baffle 50 is preferably sized, shaped and positioned to interfere with the entry of precipitation from the outside into the enclosure through the aperture 20, and to permit gas and vapour to flow through the aperture 20 and to the outside. In the preferred embodiment, the precipitation baffle 50 extends downwardly from the cover 28 inwardly of the screen 30. It will be appreciated that the baffle 50 does not need to surround the aperture 20 completely. In particular, the baffle 50 does not need to surround the upward wall section 24 of aperture wall 18, as the slanted wall portion 36 of side wall 34 prevents any entry of precipitation into the vent 10 from this direction. This is because slanted wall portion 36 of side wall 34 is connected directly to top wall 32, rather than by way of the screen 30 which contains air ventilation openings 31.

Preferably, the baffle 50 extends far enough downward from the cover 28 so that, wherever the baffle 50 surrounds the aperture 20, the lower edge of the baffle is lower than the upper edges of the corresponding wall sections of the aperture wall 18. The baffle 50 and aperture wall 18 are separated by an air gap when the cover 28 is attached to base 12, which creates a tortuous air flow pathway. The baffle 50, in combination with screen 30, creates an additional tortuous air flow pathway. The tortuous air flow pathways help inhibit moisture from entering the aperture 20, while allowing exhaust air to pass through to the outside. The baffle 50 is, in the preferred embodiment, sized, shaped and positioned to cause precipitation entering the vent 10 through the screen 30 to strike the baffle 50 and fall to the portion of the outer flange 14 between the wall sections 22 and 26 and the side wall 34 of cover 28. Furthermore, the tortuous pathway and associated redirections in the direction of airflow of the inflowing air causes a slowing down of influent air, allowing precipitation entrained in the air (i.e. snow and ice) to drop out of the inflowing air before it reaches the aperture 20, thereby reducing entry of moisture into the enclosure, for example, due to high wind speeds during heavy rainfall.

It will be appreciated that the further baffle 50 is extended from the cover to the base, the more effective it will be in intercepting precipitation before it can enter vent 10. However, if the baffle 50 extends too far from the cover 28, it will interfere with the net airflow area of the vent 10, potentially reducing it below a preferred nominal net airflow area, which in North America is 50 square inches.

The cover 28 also preferably includes one or more apertures 56 in the bottom wall portion 40. The apertures 56 are preferably contiguous with the bottom edge of the cover 28, such that, when the cover 28 is mounted to the base 12, the outer flange 14 acts as the bottom border of the apertures 56. Thus, precipitation such as rain and melted snow will tend to flow downward along the slope of the roof and out through the apertures 56. For example, it will be appreciated by those skilled in the art that, in cold weather, passive venting devices will typically absorb and conduct heat being created within the enclosure (e.g. by a furnace) faster than the surrounding roofing material.

This is, in part, because warm air from the attic flows through the vent 10 and warms it. Thus, typically, snow gathering on or near a vent 10 will melt faster than snow on other parts of the roof. For this reason, snow that collects on the base 12, between the aperture surrounding wall 18 and side wall 34 of the cover 28, will typically melt relatively quickly. The melted snow can then flow to the outside through apertures 56.

Preferably, each of the apertures 56 will be sufficiently small to prevent pests from entering under the cover 28 while at the same time, the total area of the apertures 56 can provide a significant amount of supplementary area through which gases and vapours can flow, thus increasing the venting capability of the vent 10. Though the primary route for the venting of gases and vapours to the outside is through the screen 30, the apertures 56 can act as a supplementary flow path.

Turning once more to the base 12, in a preferred embodiment of the invention, the aperture 20 will be positioned on the base 12 such that, when the cover 28 is installed on the base 12, the center of aperture 20 is displaced from the center of the cover 28 and toward the slanted wall portion 36 of side wall 34. By positioning the aperture 20 so that it is located beneath the slanted wall portion 36, the entry of precipitation into the enclosure through the aperture 20 is even further reduced. This is because the slanted wall portion 36 is solid and connects directly with top wall 32, instead of being connected by way of the screen 30 as is the case with lateral wall portions 38 and bottom wall portion 40. This eliminates a potential point of entry for precipitation or rainwater flowing down the roof and onto the side of vent 10 facing up the slope of the roof. Precipitation that does enter the vent through the screen 30 is intercepted by the baffle 50, which preferably runs inwardly of screen 30 in its entirety, and is thus diverted away from the aperture 20. Precipitation that has been diverted in this way will typically fall onto the base 12, between the aperture surrounding wall 18 and side wall 34 of the cover 28, and then flow down and out of the vent 10 through the apertures 56.

In a preferred embodiment of the invention a pair of moisture deflecting features, best seen in FIG. 2, are positioned on the base 12 such that, when the cover 28 is installed, the moisture deflecting features 55 are located just inside the lateral wall portions 38 of the cover 28. The moisture deflecting features can be provided in the form of raised moisture deflecting ribs 55. Moisture deflecting ribs 55 help prevent moisture that has fallen on the base 12 from migrating laterally beneath the side wall 34, and collecting underneath shingles that have been installed over the outer flange 14 and abutting the lateral wall portions 38 of side wall 34. Instead, the moisture is deflected downward along the slope of the roof on top of the outer flange 14 and out through apertures 56, as discussed above. Thus, moisture deflecting ribs 55 prevent water from working its way under the shingles from their sides. It is preferred, though not necessary, that the moisture deflecting ribs 55 abut the lateral wall portions 38, and extend along the entire length of the lateral wall portions 38, in order to form a complete barrier to water that may migrate laterally.

In a preferred embodiment, the moisture deflecting ribs 55 are positioned to allow the lateral wall portions 38 and base 12 to form a friction fit coupling when the cover 28 is installed onto the base 12. The friction fit coupling is effected when the lower edge of the lateral wall portions 38 engage a complementary lip 57 on the moisture deflecting ribs 55.

It will be appreciated that in this configuration, the moisture deflecting ribs 55 also provide additional structural support to the lateral wall portions 38, which can gradually deform over time as a result of heavy precipitation in the form of rain or hail. Such deformation can weaken the seal between the cover 28 and base 12, allowing moisture to enter the vent 10. Thus, by providing additional structural support, the moisture deflecting features also serve to make the vent 10 more durable and increase its life span. It will be appreciated that the moisture deflecting ribs 55 can be made as high as desired relative to the base in order to better protect against the lateral migration of water underneath lateral wall portions 38, and to provide as much additional structural support to the lateral wall portions 38 as may be desired.

In a preferred embodiment of the invention, the side wall 34 of the cover 28 also has a ridge 59 extending from its exterior side along at least a portion of the edge of the cover 28. The ridge 59 deflects precipitation that strikes the vent 10 and makes it harder for such precipitation to migrate into the vent 10 through the lateral wall portions 38 or bottom wall portion 40. The ridge 59 is best seen in FIG. 12, running along the length of lateral wall portions 38 and bottom wall portion 40.

The base 12 also includes a raised rain ridge 61 along both sides on the outside of the area covered by cover 28. The purpose of the rain ridge is to direct water toward the portion of the vent 10 disposed downwardly along the sloped roof. Since the downwardly disposed portion of the outer flange 14 is lapped over the shingles, the water is discharged off of the outer flange 14 on top of the shingles, thus preventing water from entering underneath the shingles.

In a preferred embodiment, the rain ridge 61 is molded onto the outer flange 14 during manufacturing. However, it will be appreciated by those skilled in the art that other means of forming a raised edge will provide this function. For example, the lateral edges of outer flange 14 can be bent over to form an edge channel that causes any water migrating sideways to be funnelled downwardly along the side edge and out onto the top of the shingles below the vent 10.

The base 12 further preferably includes lateral guide members 66 and bottom guide members 67, and top guide members 68, protruding from the outer flange 14. The lateral guide members 66 and bottom guide members 67 are distributed on the outer flange 14 just inside where the lateral wall portions 38 and bottom wall portion 40 of side wall 34 abut the outer flange 14 when the cover 28 is mounted to base 12. The top guide members 68 are distributed on the outer flange 14 just inside where the slanted portion 36 of side wall 34 abuts the outer flange 14 when cover 28 is mounted to the base member 12. Thus, when the cover 28 is mounted, the guide members 66, 67 and 68 are covered. The bottom guide members 67 are also positioned so that they do not interfere with or block the apertures 56 located on the bottom wall portion 40 of side wall 34 of the cover 28.

In a preferred embodiment the lateral guide members 66 and bottom guide members 67 will be equal in length, while the top guide members 68 are preferably of greater length relative to the lateral guide members 66 and bottom guide members 67. For example, in a preferred embodiment it has been found that using a length for the top guide members 68 of approximately twice that of the lateral or bottom guide members works well. However, other length ratios may also be employed. What is important is that the top guide members 68 be sufficiently long to interfere with the abutment of bottom wall portion 40 with outer flange 14, in the event that an installer incorrectly attempts to mount cover 28 to base 12 such that bottom wall portion 40 is at the top end of the device, and the apertures 56 are facing toward the downward side of the sloped roof. This serves to ensure that the cover member 28 can only be installed in the correct orientation.

As shown, the slanted wall portion 36 of the preferred vent 10 includes a flange 37 which extends and covers over the top portion of outer flange 14 to the top edge of the outer flange 14 of the base 12. The flange 37 is adapted to permit an installer to drive nails through the flange 37 and through the top portion of outer flange 14 into the roof. This seamless slant back design is in contrast to conventional slant back roof vents which have the slanted portion of the cover joined to the base with glue or welding, which joint is prone to failure.

Of course, even if the cover 28 is correctly mounted to base 12, it is necessary to ensure that the base 12 is installed in the correct orientation. If the base member 12 is installed in an incorrect orientation on the sloped roof, then the apertures 56 will not be positioned so as to be facing downward on the sloped roof. Therefore, preferably, the base member 12 is provided with an orientation indicator 70 for indicating the correct orientation of the base 12 when installed. The indicator 70 is preferably positioned on the outer flange 14, and indicates which side of the base 12 should be facing upward along a sloped roof such that, when the cover 28 is mounted correctly, apertures 56 are facing the downward side of the sloped roof. The indicator 70 may alternately be positioned on the flange 37 of slanted wall portion 36 of the cover member 28, as shown, for example, in FIG. 1.

Figure 18:
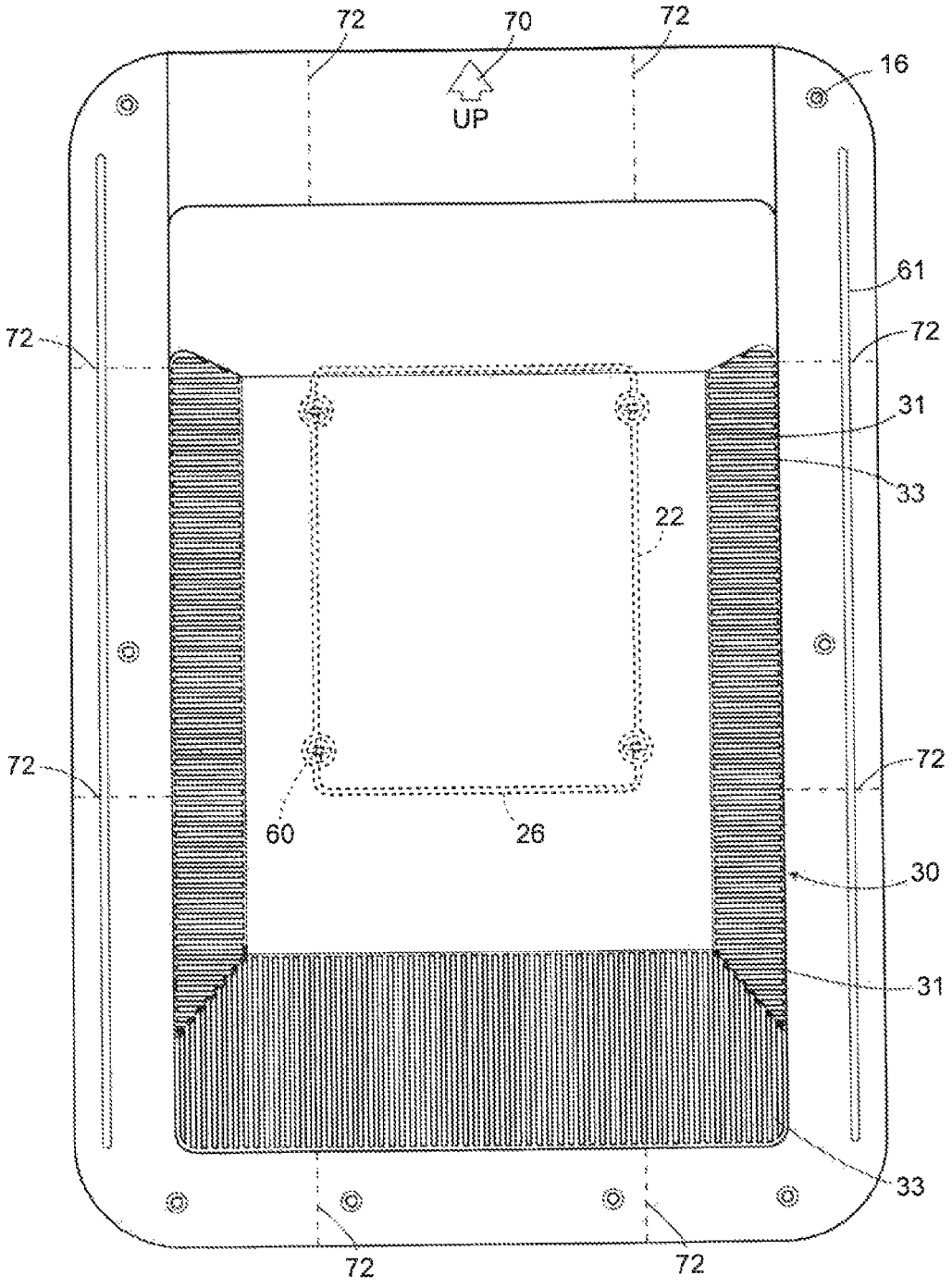
FIG. 18 is a top view of a roof vent according to another embodiment of the present invention.

With reference to FIG. 18 there is shown a roof vent 10 according to another embodiment of the present invention which includes markings to assist the installer with aligning the displaced aperture 20 with the roof opening. Preferably the markings include one or more guide lines 72 which appear faintly on the base 12, the cover 28 or a combination of the base 12 and cover 28, so they will not affect the appearance of the roof vent 10 when viewed from a distance, such as from the ground. As will be appreciated the guide lines 72 provide the installer with a means to visualize the position of the displaced aperture 20. The preferred guide lines 72 will indicate the boundaries of the aperture 20 in the base 12, which will facilitate alignment of the aperture 20 over the opening in said building enclosure.

Figure 19:
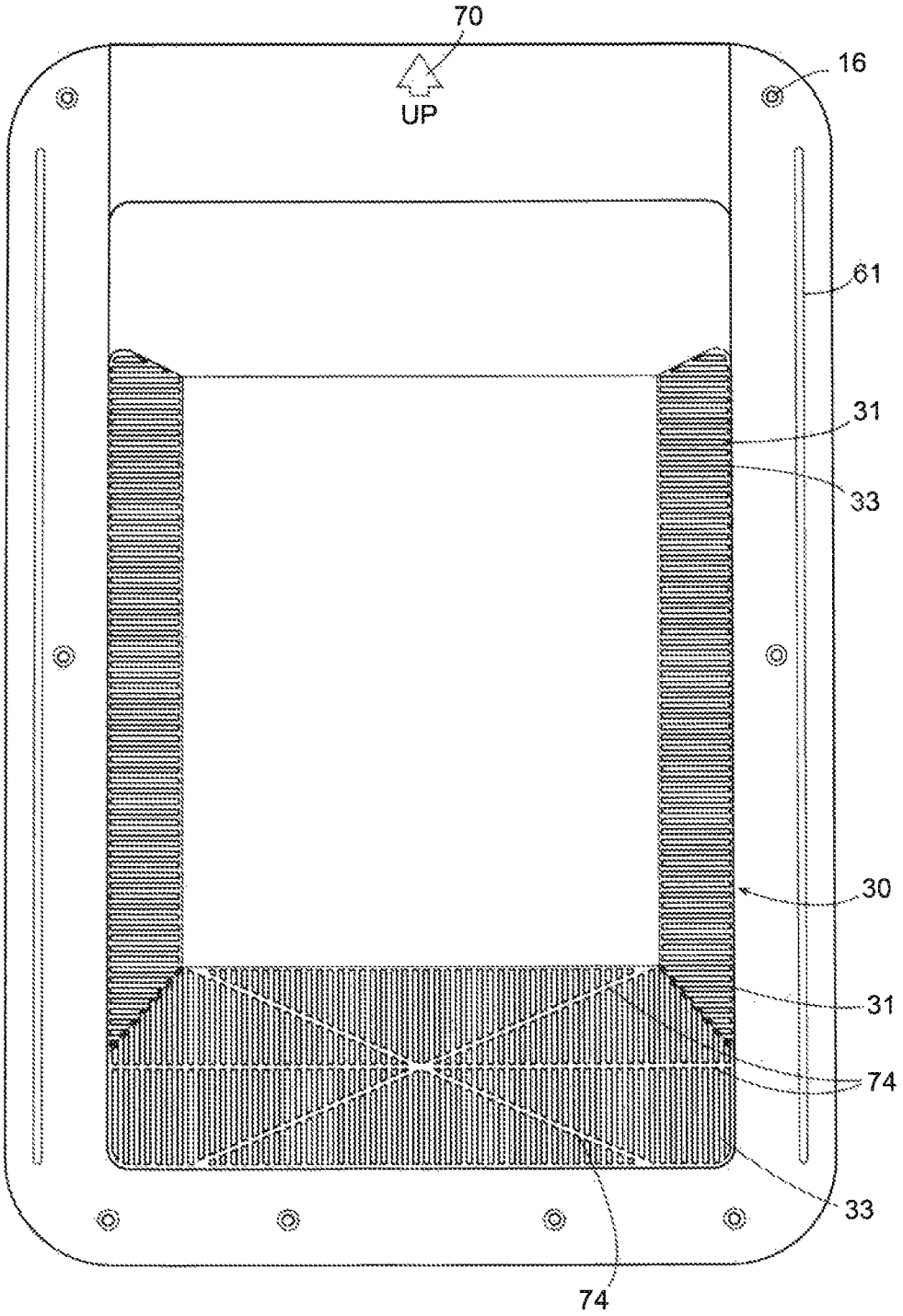
FIG. 19 is a top view of a roof vent according to another embodiment of the present invention.
Figure 20:
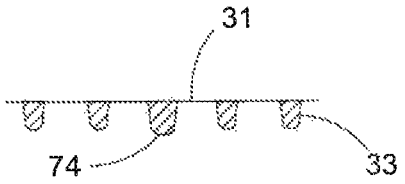
FIG. 20 is a cross sectional view of a portion of the screen of FIG. 19.

With reference to FIG. 19 there is shown a roof vent 10 according to yet another embodiment of the present invention which includes rip stop ribs 74 incorporated into the portion of the screen 30 position to face the downward side of the sloped roof. Rip stop ribs 74 are slightly wider and thicker than the slats 33, as best seen in FIG. 20. Rip stop ribs 74, being more robust than the regular slats 33 are less prone to breakage from impact of objects, such as for example debris from a tree. As will be appreciated, the increased robustness of the rip stop ribs 74 is achieved by being provided with more material in cross-section as compared to the slats 33, to permit the rip stop ribs 74, which allows them to withstand greater ripping forces from flying debris than the slats 33. Accordingly, the rip stop ribs 74 are preferably positioned on the screen to compartmentalize the damage inflicted from the objects. As shown in FIG. 19, the rip ribs 74 frame out generally triangular sections of screen 30, so that if for example a branch from a tree impacts a triangular section and initiates a rip through the slats 33, the rip will terminate when the branch contacts the rip stop rib 74, thereby limiting the rip in the screen 30 to the one triangular section.

Figure 21:
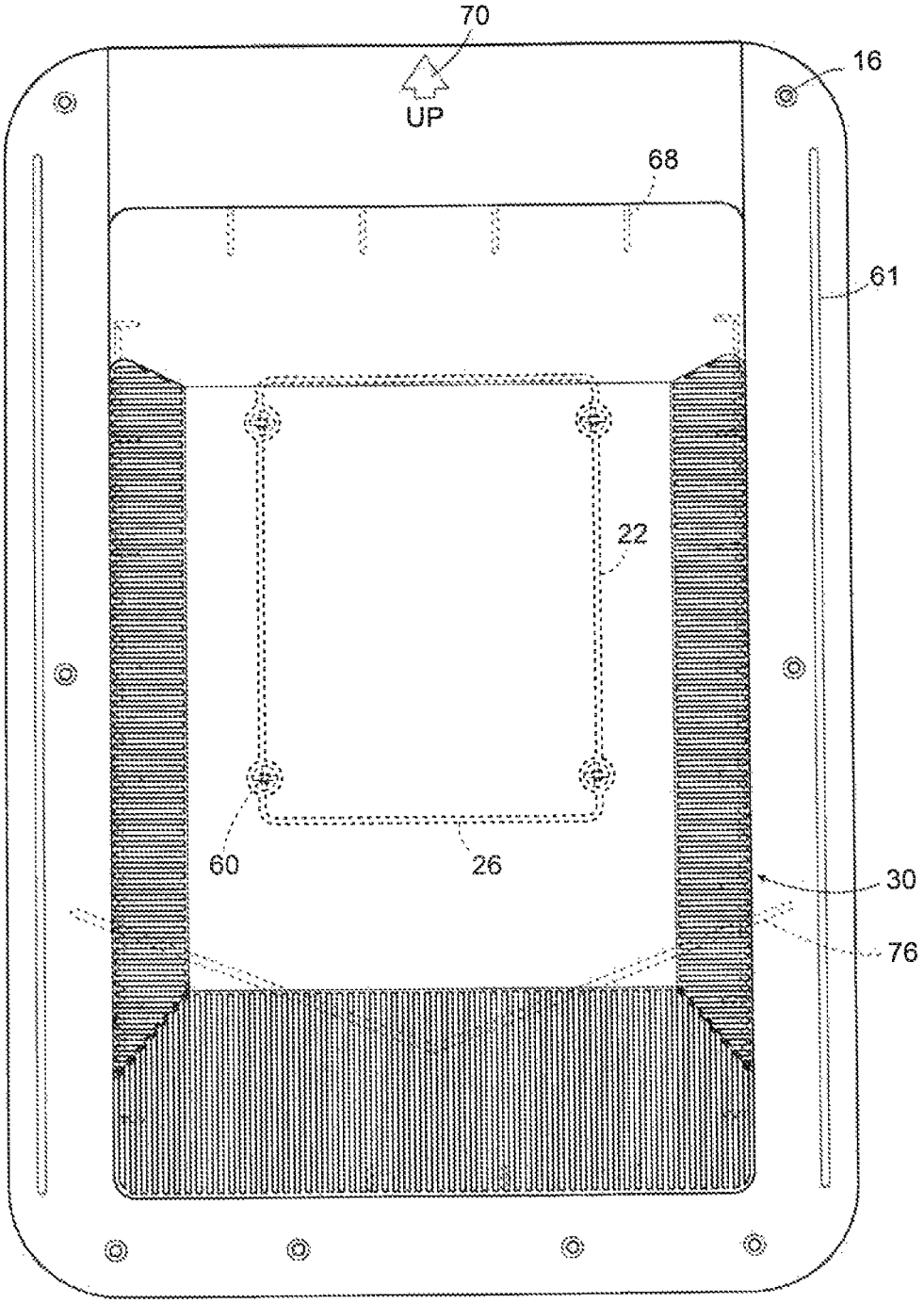
FIG. 21 is a top view of a roof vent according to another embodiment of the present invention.
Figure 22:
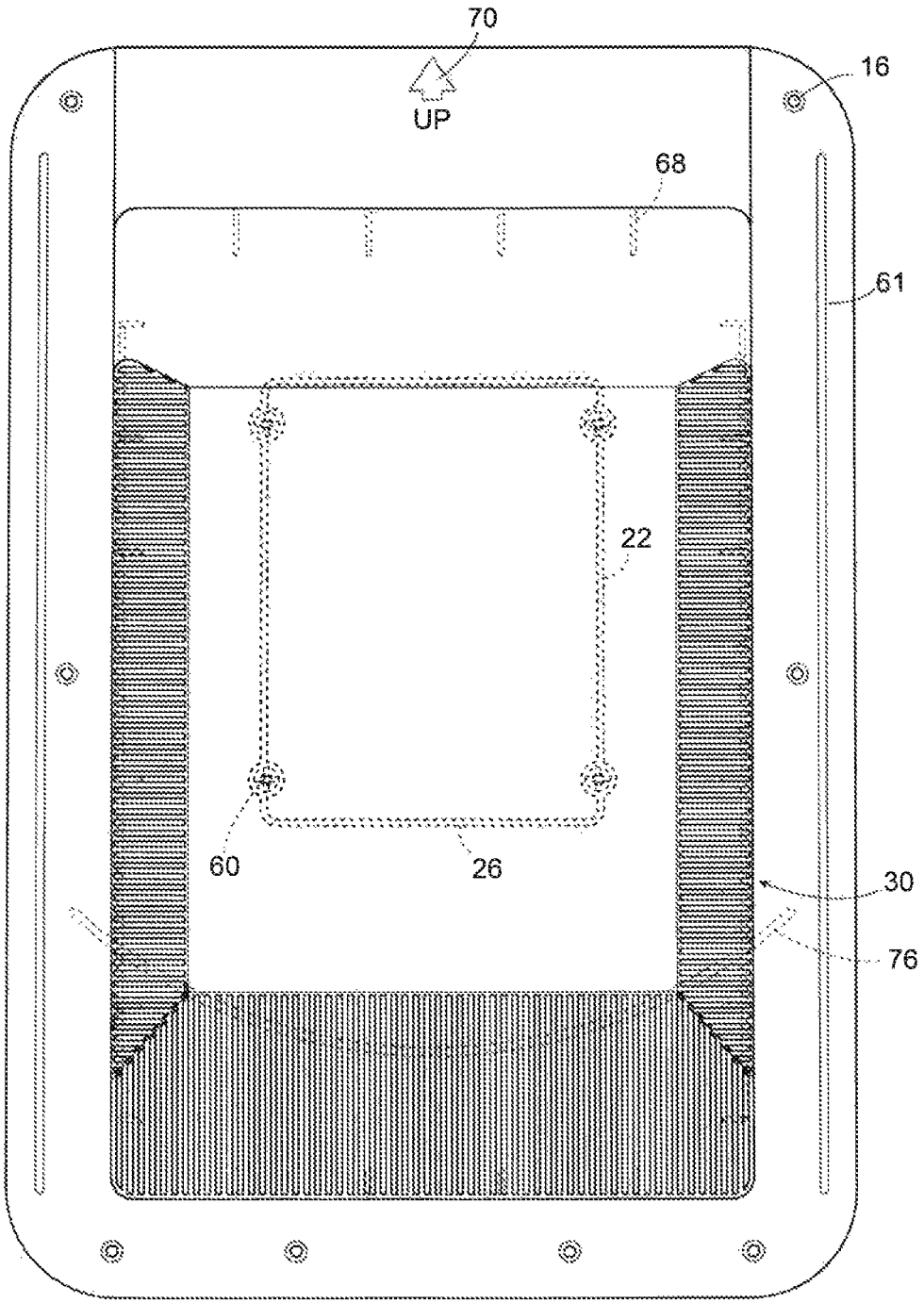
FIG. 22 is a top view of a roof vent according to another embodiment of the present invention.

It has been found that under certain conditions, water from rain, snow melt or other sourced can be driven by strong winds up the slope of the roof under the bottom of the outer flange 14 of the base 12 of the roof vent 10 to the point that it reaches the opening in the roof and drips into the building. To help prevent this path of water entry, the preferred roof vent includes a water deflector ridge 76 positioned on the underside of the base 12 as shown in FIG. 21. The water deflector ridge is raised from the bottom surface of the outer flange 14 by about 0.020 inches and positioned between the edge of the downwardly disposed portion of the vent and the aperture 20 to abut the surface of the roof when installed thereon. According to the preferred embodiment of the present invention the water deflector ridge 76 has a chevron-shape as shown in FIG. 21. However, it is also contemplated that the water deflector ridge 76 may have other shapes and still achieve the desired results. For example, the water deflector ridge 76 may have a curved shape as shown in FIG. 22. What is important is that the water deflector ridge 76 directs any water forced under the outer flange 14 to proceed up the slope of the roof between the roof and the bottom surface of the outer flange 14 in directions away from the roof opening. For example, the chevron shaped water deflector ridge 76 in FIG. 21 directs the water up the slope of the roof at angles away from the roof opening. The deflected water will then drain downwardly along the slope of the roof on top of the shingles. It will be appreciated that the water deflector ridge feature 76 is not limited to slant-back roof vents but will find application in many other roof vents configured for sloped roofs.

While reference has been made to various preferred embodiments of the invention other variations, implementations, modifications, alterations and embodiments are comprehended by the broad scope of the appended claims. Some of these have been discussed in detail in this specification and others will be apparent to those skilled in the art. Those of ordinary skill in the art having access to the teachings herein will recognize these additional variations, implementations, modifications, alterations and embodiments, all of which are within the scope of the present invention, which invention is limited only by the appended claims.

The embodiments of the invention in which an exclusive property or privilege is claimed are defined as follows:

1. A vent for venting a sloped building enclosure, the vent comprising:

a base comprising an attachment element for attaching said base to said building enclosure and an aperture to permit gas to pass in to and out of said building enclosure through said base, said base having an underside surface, and a downslope side;

a cover for covering said aperture;

at least one attachment structure configured to attach said cover to said base; and a water deflector ridge disposed on said underside surface of said base, said water deflector ridge being positioned between an edge of said downslope side and said aperture;

said water deflector ridge being adapted to deflect water forced under said base up the slope of said building enclosure, in directions along the slope of the building enclosure but away from said aperture, when said vent is installed on said building enclosure.

2. The vent as claimed in claim 1, wherein said water deflector ridge at least partially includes one of a chevron-shape, curved shape, or a combination thereof.

* * * * *

UNITED STATES PATENT AND TRADEMARK OFFICE

CERTIFICATE OF CORRECTION

PATENT NO. : 9,243,813 B2
APPLICATION NO. : 13/291396
DATED : January 26, 2016
INVENTOR(S) : James Brian Mantyla et al.

It is certified that error appears in the above-identified patent and that said Letters Patent is hereby corrected as shown below:

Specification

At column 13, line 8, the patent should read --...the rip stop ribs 74...--.

At column 13, line 15, the patent should read --...other sources can be...--.

Signed and Sealed this
Twenty-sixth Day of April, 2016

Michelle K. Lee

Michelle K. Lee
*Director of the United States Patent and Trademark Office*